US005429261A

United States Patent [19]

Machino

[11] Patent Number: 5,429,261

[45] Date of Patent: Jul. 4, 1995

[54] PLASTIC FOLDABLE BOX

[75] Inventor: Kunifumi Machino, Ena, Japan

[73] Assignee: Appax Co., Ltd., Japan

[21] Appl. No.: 224,548

[22] Filed: Apr. 7, 1994

[51] Int. Cl.[6] ..... B65D 21/08

[52] U.S. Cl. ..... 220/7; 220/6; 220/4.28; 220/675

[58] Field of Search ..... 229/117.07, 198.1, 23 R; 220/6, 7, 4.33, 4.28, 1.5, 675, 666, 669, 646, 650, 642, 643, 756, 759

[56] References Cited

U.S. PATENT DOCUMENTS

| | | | |
|---|---|---|---|
| 2,859,905 | 11/1958 | Choate | 229/198.1 |
| 3,796,342 | 3/1974 | Sanders et al. | 220/6 |
| 4,116,513 | 9/1978 | Ullman, Jr. | 220/7 |
| 4,482,074 | 11/1984 | Lalley | 220/6 |
| 4,624,380 | 11/1986 | Wernette | 220/642 |
| 5,036,979 | 8/1991 | Selz | 229/117.07 |
| 5,038,953 | 8/1991 | Radar | 220/6 |
| 5,042,713 | 8/1991 | Stafford | 229/23 R |
| 5,351,846 | 10/1994 | Carter | 220/6 |

FOREIGN PATENT DOCUMENTS

| | | | |
|---|---|---|---|
| 2853558 | 6/1980 | Germany | 220/666 |
| 4038030 | 6/1992 | Germany | 220/7 |
| 62-110132 | 7/1987 | Japan . | |
| 406099975 | 4/1994 | Japan | 220/6 |

*Primary Examiner*—Stephen J. Castellano
*Attorney, Agent, or Firm*—Parkhurst, Wendel & Rossi

[57] ABSTRACT

A light-weight, robust, foldable box which can be folded flat, comprises a bottom panel, swing side panels and folding side panels of corrugated plastics board. The bottom panel has vertical panels on both ends and a retaining portion in the vertical panels. The swing side panels are produced of corrugated plastics board used in such a direction that a core member will be vertically positioned, and are provided with a reinforcing band at the lower end and an engaging portion formed in the reinforcing band to thereby engage with the retaining portion. In the upper end of the swing side panel is formed an inside-folding line which allows the swing of the swing side panel. The folding side panel is used in such a direction that the core member of corrugated plastics board will be vertically positioned, and is provided with inside-folding lines in the upper and lower portions and with an outside-folding line at the center between the inside-folding lines provided in the upper and lower portions, so that the folding side panel may be folded to a sidelong V-shaped form. The swing side panel and the folding side panel are connected in a portion above the uppermost inside-folding line.

1 Claim, 8 Drawing Sheets

PLASTIC FOLDABLE BOX

BACKGROUND OF THE INVENTION

1. Field of the Invention

The present invention relates to a foldable box which can be folded to a compact size.

2. Description of the Related Art

A conventional foldable box, as disclosed in, for example, Japanese Utility Model Laid-Open No. Sho 62-110132, comprises a square tray-like bottom panel, a picture frame-like upper frame formed in substantially the same size as the bottom panel, two swing side panels rotatably pivoted on two opposite sides of the upper frame, and a folding side panel which can be bent into a sidelong V-shaped form and pivotally mounted at the upper and lower ends to the upper frame and the bottom panel. The swing side panels are raised to thereby support the folding side panel upright. When the swing side panels are turned inwardly to a horizontal position, the folding side panel is folded inside the box, so that the box can be folded flat.

Such a foldable box described above is in most cases an injection-molded product of synthetic resin.

The prior art foldable box, however, has the following problems.

Firstly, since a mold for injection molding of synthetic resin is expensive and accordingly the unit price of the box becomes high, and moreover, since there must be prepared as many molds as the number of sizes required, the injection molding is unsuitable for producing many kinds of boxes in small quantities. It is, therefore, impossible to meet every detail of a customer's need.

Secondly, since the box itself becomes very heavy, a wastefully high transportation cost and much burden in loading and unloading work will be required.

SUMMARY OF THE INVENTION

It is therefore an object of the present invention to provide a foldable box which includes the following constitution requirements (1) to (6) for solving all of the above-described problems.

(1) The box 1 comprises at least a bottom panel 2 having a square form in a plan view, two swing side panels 3 located on two opposite sides of the bottom panel 2, and two Folding side panels 4 located on the remaining two sides of the bottom panel 2.

(2) Each of the panels 2, 3 and 4 stated above is produced of a corrugated plastics board including a core member 8*c* of synthetic resin sandwiched between two synthetic resin base panels 8*a* and 8*b*.

(3) The bottom panel 2 is made up of vertical fixed panels 9 on both ends provided in a direction intersecting the core member 8*c* at right angles, and a retaining portion 10 formed on the vertical panel 9.

(4) The swing side panel 3 is produced of the corrugated plastics board used in such a direction that the core member 8*c* will be vertical. At the lower end a reinforcing band 11 is disposed in a direction intersecting the core member 8*c* at right angles, and an engaging portion 12 which engages with the retaining portion 10 of the vertical panel 9 is formed on the reinforcing band 11. At the upper end of the swing side panel 3 is formed a horizontal inward-folding line 14a cut deep except only the base panel 8*b* of corrugated plastics board. The base panel 8*b* left uncut serves as a hinge portion to allow the swinging of the swing side panel 3 towards the inside of the box 1.

(5) The folding side panel 4 is produced of the corrugated plastics board used in such a direction that the core member 8*c* will be vertical, and is provided, in the upper and lower portions, with horizontal inward-folding lines 14*b* and 14*c* cut deep except only the base panel 8*b* of corrugated plastics board, and, at center between the inward-folding lines 14*b* and 14*c* cut in the upper and lower portions, with a horizontal outside-folding line 14*d* cut deep except the base panel 8*a* of corrugated plastics board, thereby allowing folding into a sidelong V-shaped form.

(6) The swing side panel 3 and the folding side panel 4 are connected in a portion above the uppermost inward-folding lines 14*a* and 14*b*.

The swing side panel 3 and the folding side panel 4, produced of the corrugated plastics board which is used in such a direction that the core member 8*c* will be vertical, has a strength great enough to withstand a vertical force which acts during baggage conveyance and piling up of boxes. Moreover, the reinforcing band 11 is provided at the lower end of the swing side panel 3 to thereby increase rigidity relative to torsion and lateral pressure added to the swing side panel 3. Furthermore, provided upright at both ends of the bottom panel 2 are vertical panels 9, which engage with the swing side panels 3, thereby improving the strength of the bottom panel 2 itself. In addition, since a load applied to the bottom panel 2 is partly supported by the swing side panels 3, the box can fully withstand even a heavy load.

The above and other objects, features and advantages of the present invention will be more clear from the following description with reference to the accompanying drawings.

DESCRIPTION OF THE PREFERRED EMBODIMENTS

Figure 1:
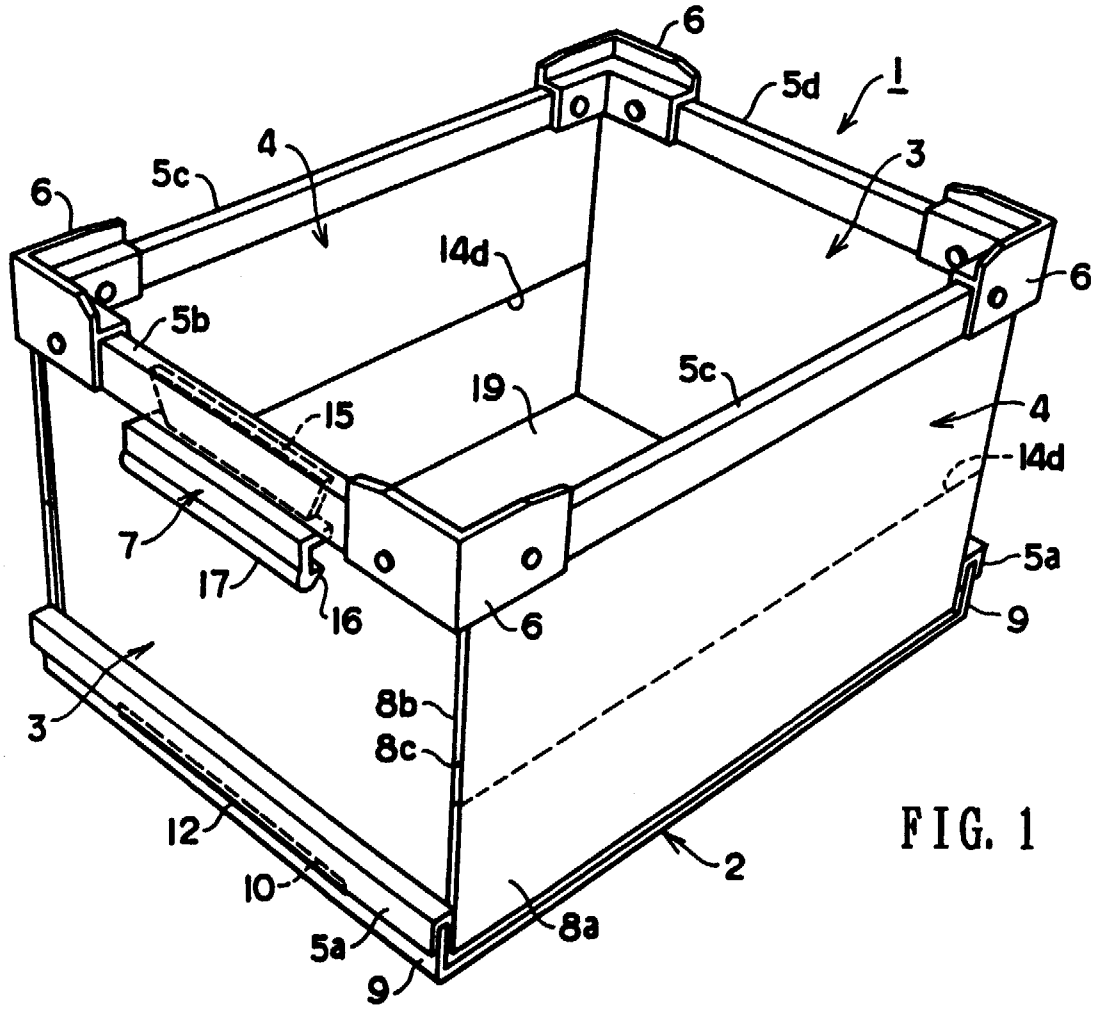
FIG. 1 is a perspective view of a box.
Figure 2:
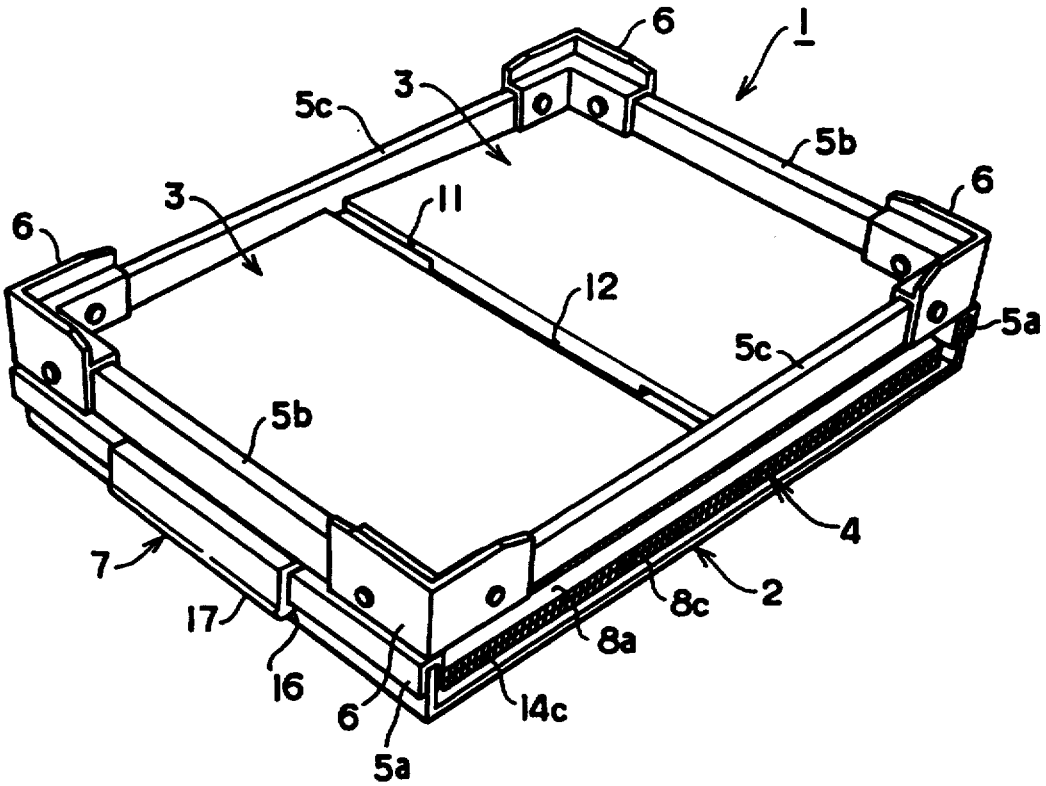
FIG. 2 is a perspective view of the box in a folded state.
Figure 3:
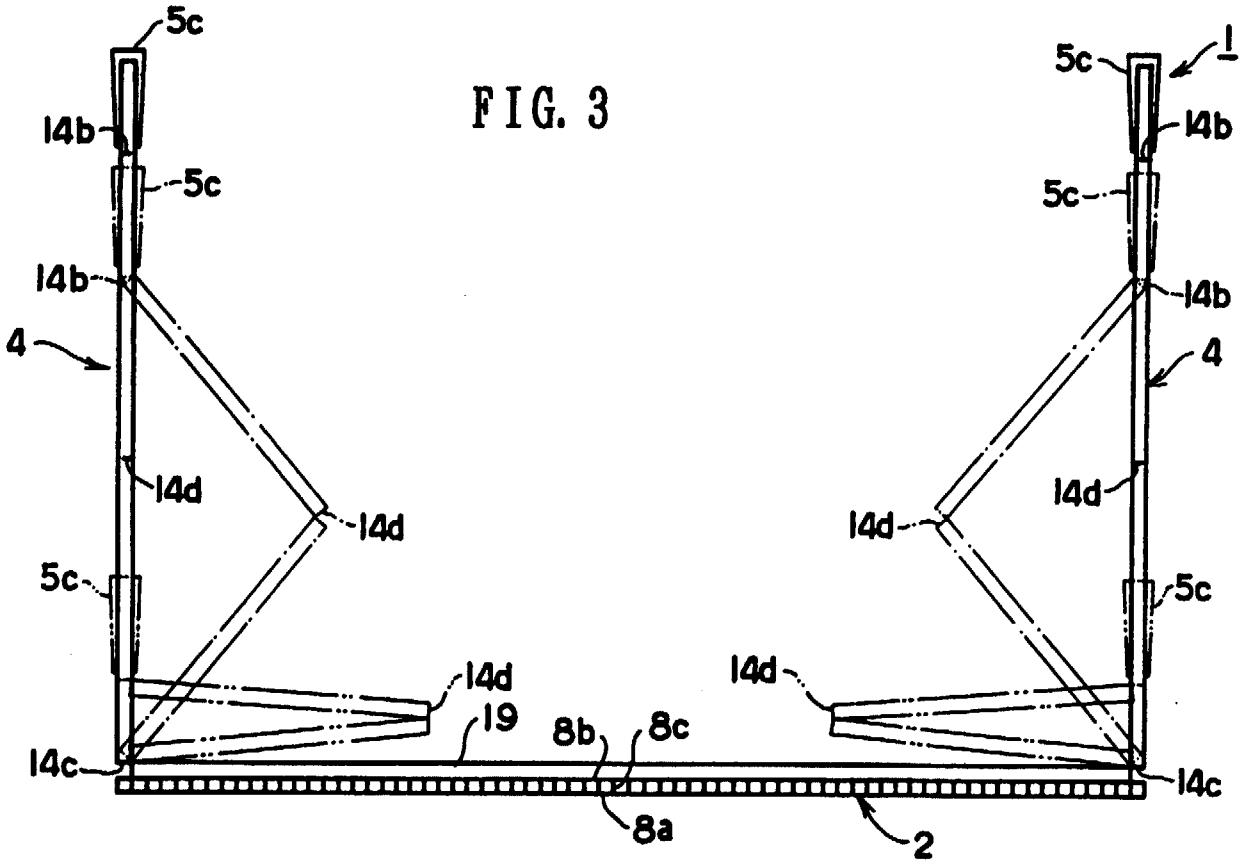
FIG. 3 is a longitudinal sectional view of the box.
Figure 4:
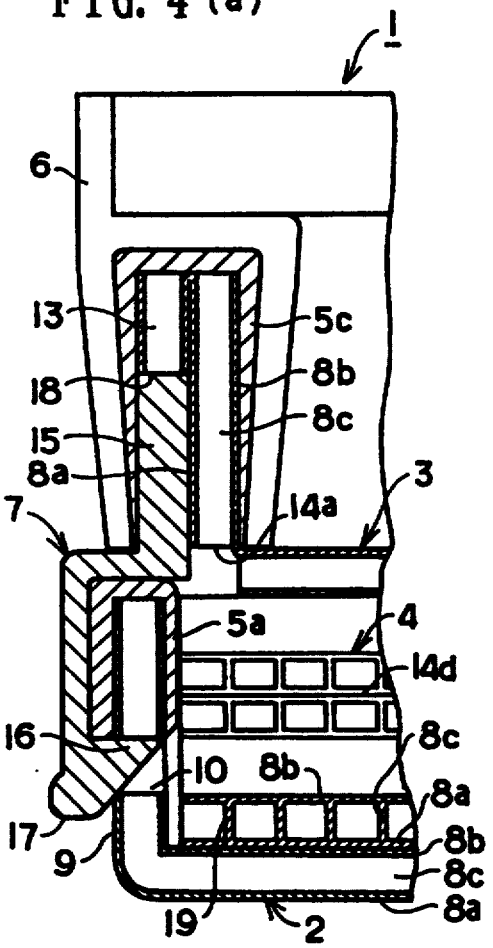
FIGS. 4(A) and 4(B) are partly enlarged sectional views of the box.
Figure 4:
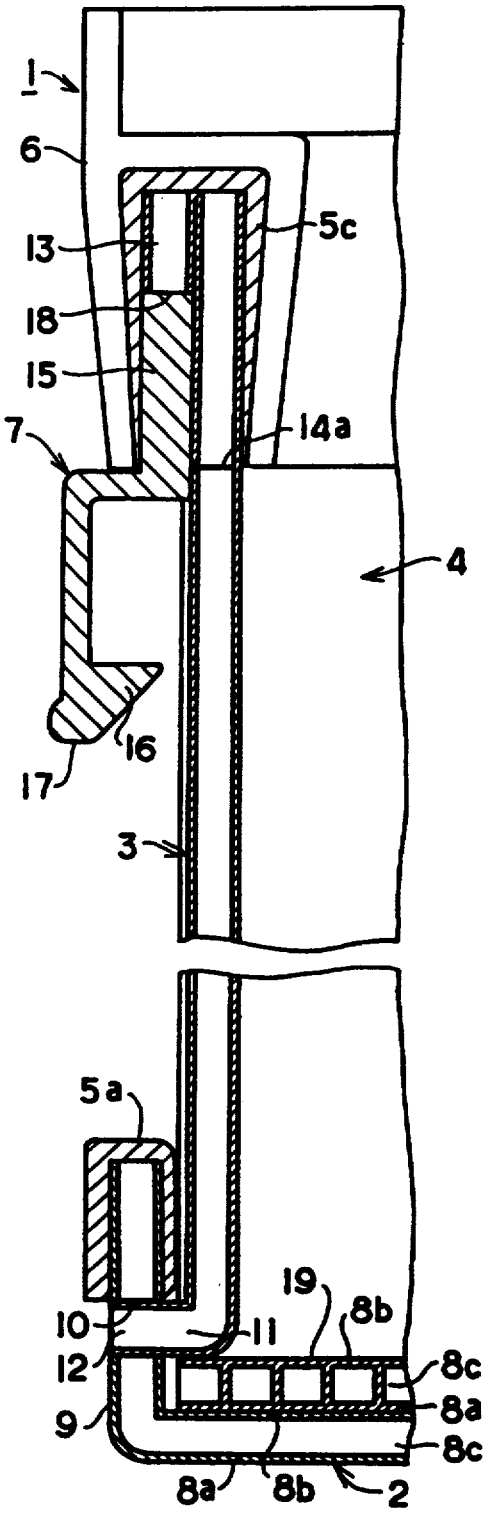
Figure 5:
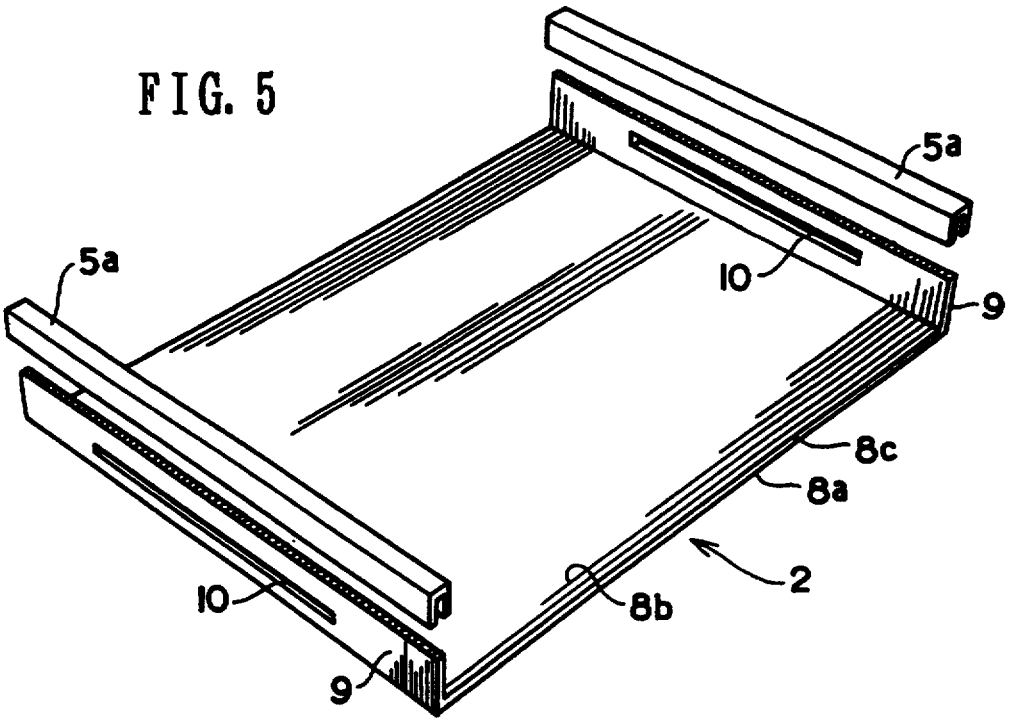
FIG. 5 is an exploded perspective view of a bottom panel.
Figure 6:
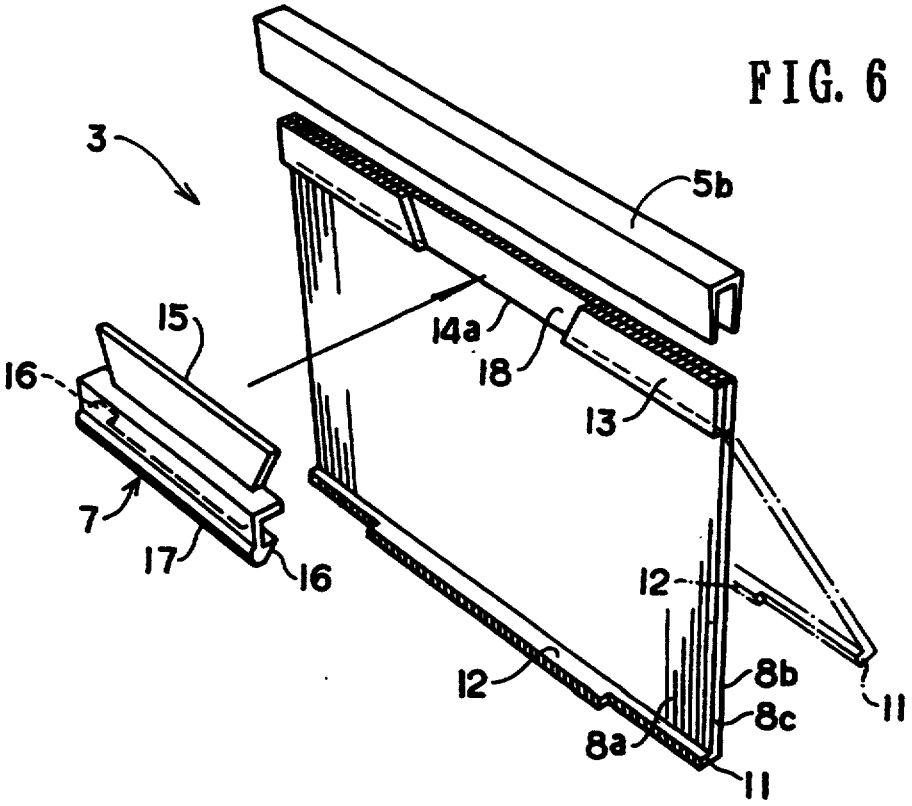
FIG. 6 is an exploded perspective view of a swing side panel.
Figure 7:
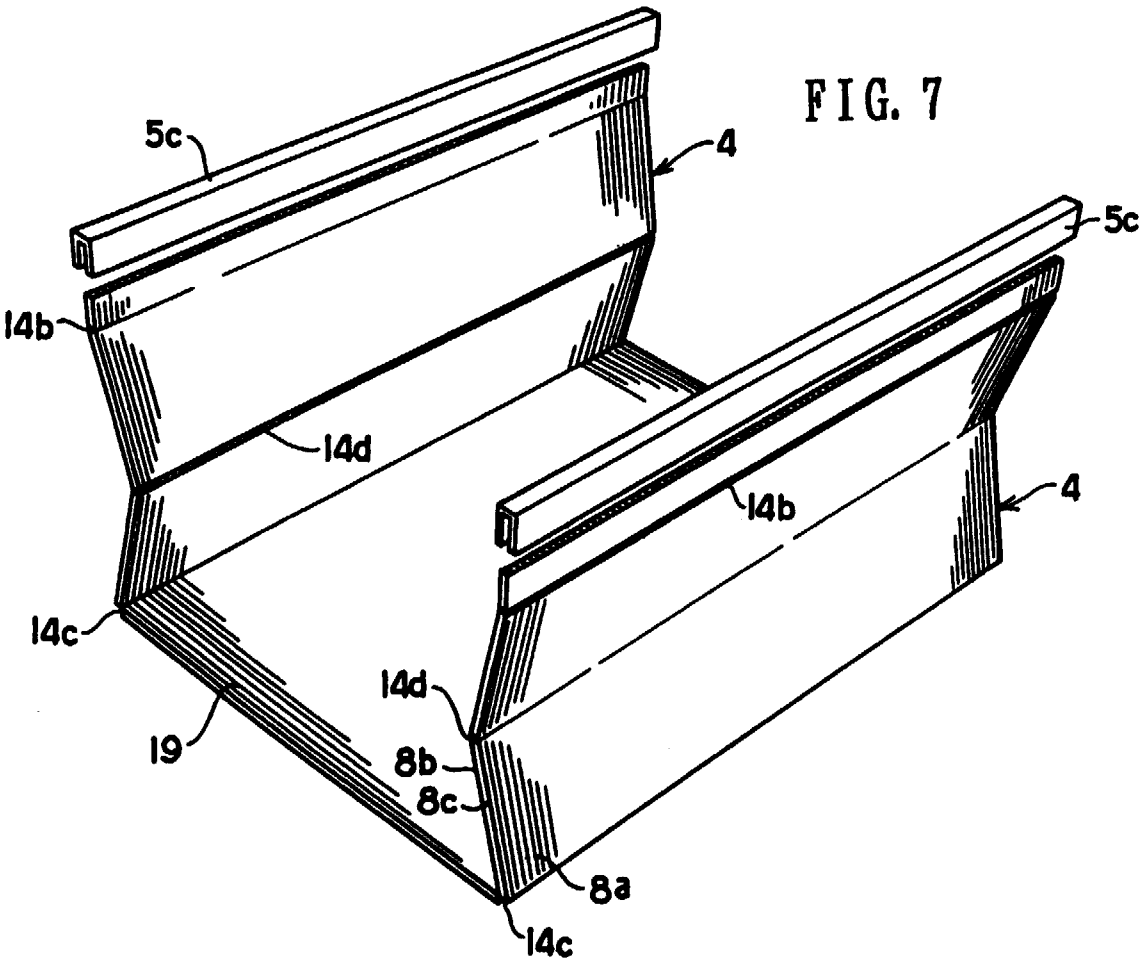
FIG. 7 is am exploded perspective view of a folding side panel.

Preferred embodiments of a foldable box according to the present invention will now be explained with reference to the accompanying drawings. FIG. 1 is a perspective view of the box; FIG. 2 is a perspective view of the box in a folded state; FIG. 3 is a longitudinal sectional view of the box; FIGS. 4(A) and 4(B) are partly enlarged sectional views of the box; FIG. 5 is an exploded perspective view of a bottom panel; FIG. 6 is an exploded perspective view of a swing side panel; and FIG. 7 is an exploded perspective view of a folding side panel.

The box 1 includes a rectangular bottom panel 2 in a plan view, two swing side panels 3 located on two opposite sides of the bottom panel 2, two folding side panels 4 located on the remaining two sides of the bottom panel 2, molding members 5*a* to 5*c* covering the end portion of the panels 2, 3 and 4, a corner member 6 connecting the side panels 3 and 4 with each other, and a handle member 7 provided on the swing side panel 3.

The bottom panel 2, swing side panels 3, and folding side panels 4 are each produced of a well-known corrugated plastics board where a polypropylene core member 8*c* is interposed between two polypropylene base panels 8*a* and 8*b* in an integral manner.

The bottom panel 2, as shown in FIG. 5, has vertical panels 9 fixedly formed at both end portions intersecting the core member 8*c* at right angles. The vertical panels 9 formed by thermally bending both end portions of the bottom panel 2 at right angles, has a groove-like retaining portion 10, and the synthetic resin molding member 5*a* fitted on the upper edge.

The swing side panel 3, as shown in FIG. 6, is produced of the corrugated plastics board, which is used in such a direction that the core member 8*c* will be vertically positioned. On the lower end of the swing side panel 3 is provided a reinforcing band 11 in a direction intersecting the core member 8*c* at right angles. The reinforcing band 11 in the present embodiment is of such a construction that the lower end of the swing side panel 3 is bent through about 90 degrees by a method similar to the vertical panel 9 of the bottom panel 2, to thereby increase the rigidity of the swing side panel 3. The reinforcing band 11, as shown in FIGS. 4(B) and 6, is provided with a lug-like engaging portion 12 to be engaged with the retaining portion 10 of the vertical panel 9.

In the meantime, on the upper end of the swing side panel 3 is folded a folding piece 13, using the outer base panel 8*a* as a hinge. The synthetic resin molding member 5*b* is fitted over the folded portion. In the upper end of the swing side panel 3 is formed an inward-folding line 14*a* cut along the lower edge on the outer side of the molding member 5*b*, leaving the inner base panel 8*b* of the corrugated plastics board uncut. The inner base panel 8*b* serves as a hinge portion so that the swing side panel 3 will swing towards the inside of the box 1.

On the upper part of the swing side panel 3 is attached the synthetic resin handle member 7. The handle member 7 has a sectional form of crank as shown in FIGS. 4(A) and (B) and is provided, at the upper part, with an invertedly trapezoidal inserting portion 15 and, at the lower part, with a finger engaging portion 17 having inward-facing pawls 16 and 16. The handle member 7 is securely fastened by fitting the inserting portion 15 into an invertedly trapezoidal recess 18 provided in the folding piece 13 of the swing side panel 3, and further by fitting the molding member 5*b* thereon.

In the folding side panel 4, as shown in FIG. 7, the corrugated plastics board is used in such a direction that the core member 8*c* will be vertical; the two folding side panels 4 are connected into one body through a reinforcing panel 19 placed on the bottom panel 2. On the upper edge of the folding side panel 4 is fitted the molding member 5*c*, along which outer lower edge an inside-folding line 14*b* is formed. The inside-folding line 14*b* is cut deep except the inner base panel 8*b* of the corrugated plastics board. This inner base panel 8*b* left uncut serves as a hinge portion. An inside-folding line 14*c* of the same formation as the inside-folding line 14*b* is provided along a border portion between the folding side panel 4 and the reinforcing panel 19. The folding side panel 4 is further provided with a horizontal outside-folding line 14*d* cut, except the outer base panel 8*a*, at the center between the inside-folding lines 14*b* and 14*c*.

The folding side panel 4 is designed to be connected to the bottom panel 2 by bonding the reinforcing panel 19 to the upper surface of the bottom panel 2. The swing side panel 3 is disposed on two sides of the bottom panel 2 provided with the vertical panel 9, and is connected by riveting to the folding side panel 4 through the corner member 6 at a corner where the swing side panel 3 and the folding side panel 4 butt against each other. The swing side panel 3 is connected integrally with the folding side panel 4 in a portion above the uppermost inside-folding lines 14*a* and 14*b*. A space for holding goods is thus formed in the box 1 by supporting the folding side panels 4 straight with the wing side panels 3 set upright.

Since the engaging portion 12 of the swing side panel 3, in this state, is engaged with the retaining portion 10 of the vertical panel 9 as shown in FIG. 4(B), the load applied to the bottom panel 2 is partly supported by the swing side panels 3; accordingly, the box containing goods will not be broken when raised. The corrugated plastics board, as generally well known, displays a great strength against a force acting in a direction parallel to the core member 8*c*. The box 1 according to the present invention has the side panels 3 and 4 formed such that the core member 8*c* will become vertical, and therefore will not collapse under a substantial load. It is, therefore, possible to stack up the box 1 in many layers. And furthermore, the bottom of the box can be substantially increased in strength by using the core member 8*c* of the reinforcing panel 19 on the bottom panel 2 in an intersectional fashion as in the present embodiment.

Next, a method of using the box 1 will be explained.

To fold the box 1 into a using form as shown in FIG. 1, first the swing side panels 3 are forced to turn inside. Then, the folding side panels 4 lose their support, to be bent by themselves down into a sidelong V-shaped form. Furthermore, when the upper surface of the box 1 is pushed, the pawl 16 of the handle member 7 goes, while deflecting, over the side face of the molding member 5*a* of the vertical panel 9 into engagement with the retaining portion 10 of the vertical panel 9 as shown in FIG. 4(A), thereby firmly locking a folded form shown in FIG. 2.

Next, to unfold the box 1 into the using form shown in FIG. 1, first the box 1 is spread outside, holding the finger engaging portion 17 of the handle member 7, to thereby release the pawls 16 out of engagement with the retaining portion 10. When, in this state, the handle member 7 is pulled upward, the folding side panel 4 extends slightly with the weight of the bottom panel 2 and the reinforcing panel 19. Subsequently, when the swing side panel 3 is pushed in towards the bottom panel 2, both side edges of the swing side panel 3 press to spread out the inside of the folding side panel 4. Then, when the swing side panel 3 stands almost fully upright to engage the engaging portion 12 with the retaining portion 10 of the vertical panel 9, the folding side panel 4 extends straight upright as indicated by a solid line in FIG. 3, thereby stabilizing in the form shown in FIG. 1.

The embodiment of the foldable box according to the present invention has heretofore been explained. It should be understood, however, that the present invention is not limited thereto.

Figure 8:
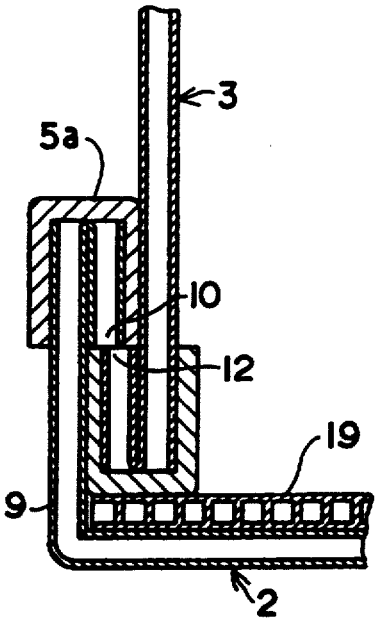
FIG. 8 is a partly sectional view of another embodiment.

For example, the engaging portion 12 of the swing side panel 3 and the retaining portion 10 of the vertical panel 9, as shown in FIG. 8, may be of such a construction that their both edges are engaged by folding both the lower end of the swing side panel 3 and the upper end of the vertical panel 9 together. In this case, the pawl 16 may be set to a size which allows engagement of the pawl 15 with the lower surface of the bottom panel 2 or the lower edge of the molding member 5*a*, or may be dispensed with if no locking is needed at the time of folding.

Figure 9:
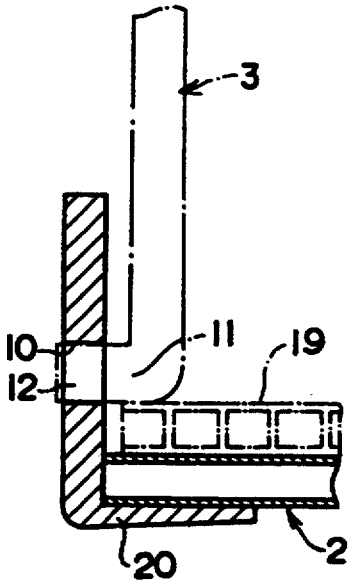
FIG. 9 is a partly sectional view of another embodiment.

Furthermore, the vertical panel 9 may be changed to an L-shaped member 20 of synthetic resin which is riveted to both edges of the bottom panel 2 formed into a flat plate, as shown in FIG. 9.

Figure 10:
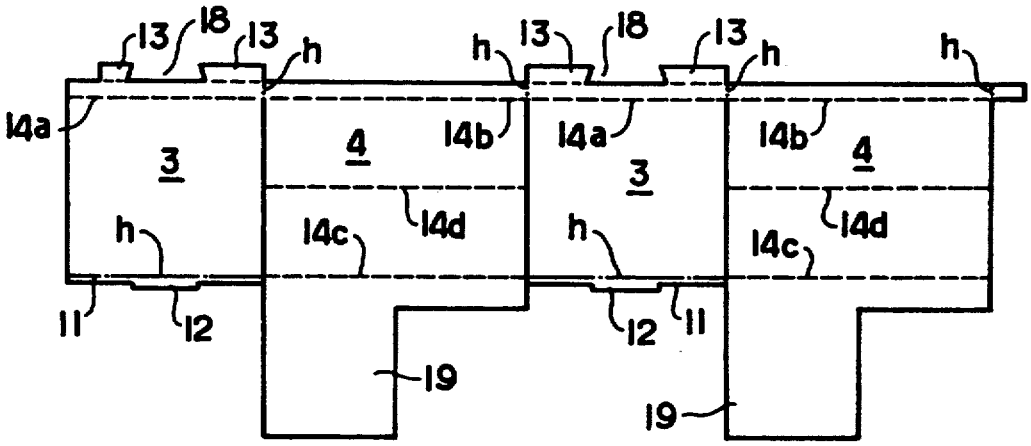
FIG. 10 is an exploded view of another embodiment.

Furthermore, in the present embodiment, the swing side panel 3 and the folding side panel 4 are formed separately, but they may be produced of a single corrugated plastics board as shown in the exploded view of FIG. 10. In the drawing, the fold line (h) is a portion to be thermally deformed.

The inside- and outside-folding lines cut straight in the swing side panel 3 and the folding side panel 4 are most preferable in the respect of the strength of the hinge portion and such a particular function that the hinge portion bends only in one direction. In some cases, however, the fold lines may be formed in a shape of V-groove. When the V-grooves are adopted, the base panel forming the hinge portion may be used either inside or outside. For example, the hinge portion of the inside-folding line 14*a* of the swing side panel 3 may be formed of the outer base panel 8*a*.

The box, if constructed in a foldable manner, has many movable portions, necessarily decreasing in strength. In the box 1 according to the present invention, therefore, the swing side panel 3 and the folding side panel 4 are provided with the core member 8*c* of corrugated plastics board directed vertically; the reinforcing band 11 on the lower end of the swing side panel 3; and the vertical panels 9 set upright at both ends of the bottom panel 2 in such a manner as to be engaged with the swing side panel 3. It, therefore, has become possible to provide the foldable box of corrugated plastics board with a substantial strength for practical use.

The foldable box 1 made of corrugated plastics board is superior in the following points to a conventional injection-molded box: firstly, the size of the box 1 can be changed as desired by changing the cutting dimensions of the corrugated plastics board, and moreover, the use of a mold which will increase the cost of the box 1 is not needed, and accordingly, the box is suitable for production of many kinds of boxes in small quantities, meeting every detail of customer's needs; secondly, since the box becomes lighter than the injection-molded box, a transportation cost can be reduced and the load-handling workers' burden can be lessened; and thirdly, since strong hinge portions can be made simply by cutting fold lines in the swing side panels 3 and the folding side panels 4, the box can be manufactured and assembled very easily.

Furthermore, notwithstanding a manufacturing cost a little higher than that of a conventional box of corrugated paper board, which, being non-reusable, wastes resources and moreover is hard to be disposed of after use, the box 1 according to the present invention has such advantages that it is reusable several times and accordingly is more economical than the box of corrugated paper board; furthermore as it is repetitively reusable, wastes to be disposed as well as resource consumption can be held to extremely little volume.

What is claimed is:

1. A foldable box comprising:

at least a bottom panel of a square form in a plan view;

two swing side panels positioned on two opposite sides of said bottom panel; and two folding side panels positioned on the remaining two sides of said bottom panel, wherein each of said panels is produced of corrugated plastics board including a core member of synthetic resin sandwiched between two synthetic resin base panels;

said bottom panel having vertical panels fixedly secured on both ends in a direction intersecting said core member at right angles, and a retaining portion formed on said vertical panel, said swing side panel being produced of corrugated plastics board used in such a direction that said core member will be vertically positioned, and having, at the lower end, a reinforcing band disposed in a direction intersecting said core member at right angles, and an engaging portion formed on said reinforcing band and engaged with said retaining portion of said vertical panel, and, at the upper end of said swing side panel, a horizontal inside-folding line cut deep through except only one of said base panels of corrugated plastics board, said one base panel left uncut serving as a hinge portion to allow said swing side panel to swing towards the inside of said box, said folding side panel being produced of corrugated plastics board used in such a direction that said core member will be vertically positioned, and being provided, in upper and lower portions, with horizontal inside-folding lines cut deep through except only one of said base panels of corrugated plastics board, and, at the center between said inside-folding lines cut in the upper and lower portions, with a horizontal outside-folding line cut deep through except only one of said base panels of corrugated plastics board, thereby allowing folding to a sidelong V-shaped form, and wherein said swing side panel and said folding side panel being connected in a portion above the uppermost inside-folding lines.

* * * * *